US005438349A

United States Patent [19]

Fox et al.

[11] Patent Number: 5,438,349

[45] Date of Patent: Aug. 1, 1995

[54] THERMAL PRINTER LABEL GAP SENSOR AND METHOD FOR CONTROLLING SAME

[75] Inventors: Duane M. Fox, Snohomish; Joel A. Schoen, Redmond, both of Wash.

[73] Assignee: Intermec Corporation, Everett, Wash.

[21] Appl. No.: 888,044

[22] Filed: May 22, 1992

[51] Int. Cl.[6] ..... B41J 15/04; B41J 15/06

[52] U.S. Cl. ..... 346/136; 226/2; 226/10; 226/24; 226/27; 226/45

[58] Field of Search ..... 346/136, 76 PH, 134; 400/120, 578; 226/1, 2, 10, 24, 27, 45

[56] References Cited

U.S. PATENT DOCUMENTS 4,699,531 10/1987 Ulinski, Sr. et al. ..... 346/76 PH
5,061,946 10/1991 Helmbold et al. ..... 346/136
5,061,947 10/1991 Morrison et al. ..... 346/136
5,206,662 4/1993 Fox et al. ..... 346/76 PH

*Primary Examiner*—Huan H. Tran
*Attorney, Agent, or Firm*—Seed and Berry

[57] ABSTRACT

An apparatus and method for sensing gaps between labels adhered to a backing material in longitudinally spaced-apart positions as the backing material travels along the print path of a thermal printer. An array of light-emitting diodes oriented transverse to the print path illuminates the backing material. A fiber optic detects the light transmitted through the backing material and passes the light to a photodiode. The photodiode produces an analog electrical signal indicative of the amount of light transmitted, which varies depending on whether the light has passed through only the backing material or through both the backing material and the print media it carries. The analog signal is converted to a digital signal which is processed by a microprocessor to monitor and control the advancement of the print media and backing material through the printer.

46 Claims, 10 Drawing Sheets

THERMAL PRINTER LABEL GAP SENSOR AND METHOD FOR CONTROLLING SAME

TECHNICAL FIELD

The present invention relates to thermal printers and more particularly to a method and apparatus for measuring the gap between labels as they are being printed.

BACKGROUND OF THE INVENTION

It is known in the prior art to use printers with thermal printheads to produce contrasting images on a print medium such as a label stock. In one form, such printheads directly contact a thermally sensitive print medium. In others, a ribbon carrying a thermally transferrable dyed wax is placed between the printhead and a thermally insensitive print medium.

The wide applicability of such printers allows them to be used with different types of print medium, many of which use a printable material carried through the printer on a removable strip of backing material. The print medium may include separate pieces of printable material, such as self-adhesive labels, with gaps between the adjacent edges of the labels. The print medium can have many different characteristics, for example, having several different possible thicknesses.

It is important for the printer to coordinate the operation of the printhead and movement of the print medium, and especially the leading edges of the labels carried by the strip of backing material, so that the images can be placed in the desired position on the labels. Therefore it is desirable to have a printer that can sense the gaps between labels, or in other words, the leading or trailing edges of the labels, and control its operation based on the passage of the labels through the printer.

SUMMARY OF THE INVENTION

In one aspect, the invention is an apparatus for sensing the passage of print media carried by a continuous length of backing material in longitudinally spaced-apart positions along the length of the backing material as the backing material passes along a print path.

The apparatus comprises a light source and a light sensor. The light source is positioned along the print path producing a light on one side of the backing material which illuminates the backing material as it travels by the light source, the light source producing light of sufficient intensity to pass through the backing material. The light sensor is positioned along the print path to a side of the backing material opposite the light source at a position to receive light from the light source passing through the backing material, the light sensor detecting transmissivity based on the received light and generating an indicator signal indicative of whether the received light has passed through only the backing material or has passed through the backing material and the print media carried by the backing material.

In another aspect, the invention is a method for page sensing the passage of print media carried by a continuous length of backing material in longitudinally spaced-apart positions along the length of the backing material as the backing material travels along a print path.

The method comprises the steps of: (a) producing a light on one side of the backing material which illuminates the backing material as it travels along the print path, the light having a sufficient intensity to pass through the backing material; (b) receiving light from the light source at an opposite side of the backing material after it has passed through the backing material and any print media carried thereby; (c) detecting variations in the received light; and (d) generating an indicator signal based on detected variations in the received light indicative of whether the received light has passed through only the backing material or has passed through both the backing material and the print media carried by the backing material.

DETAILED DESCRIPTION OF THE INVENTION

Figure 1:
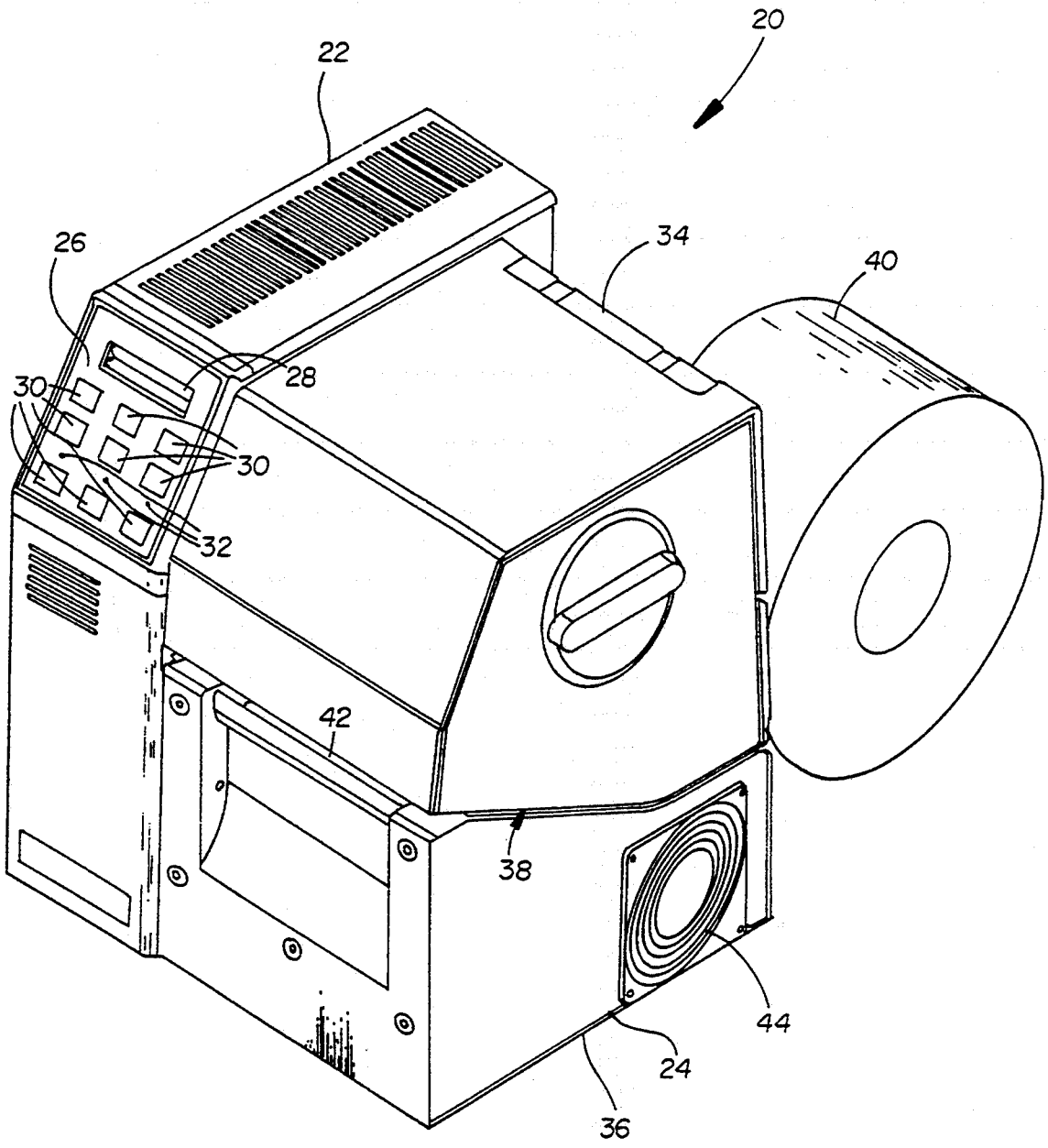
FIG. 1 is a perspective view of a thermal printer using the present invention for printing on a print medium passing along a print path, the print path being closed.

FIG. 1 is a perspective view of a thermal printer 20 for printing on a print medium passing along a print path. In FIG. 1 the print path is closed. The thermal printer 20 includes a first housing 22 and a second housing 24. The first housing 22 encloses electrical components mounted on printed circuit boards. The first housing 22 also includes a control panel 26 which allows the thermal printer 20 to be controlled and adjusted by a user.

The control panel 26 includes a liquid crystal display (LCD) 28, a plurality of buttons 30, and a plurality of light-emitting diodes (LEDs) 32. The LCD 28 provides an alphanumeric display of various commands useful for the user to control and adjust the thermal printer 20. The buttons 30 implement the user's choices of controls and adjustments, and the LEDs 32 provide displays of the status of the thermal printer 20. For example, one of the buttons 30 can be used to toggle the thermal printer 20 on- and off-line, with one of the LEDs 32 lighting to indicate when the printer is on-line. Another one of the buttons 30 can be used to select an array of menus including choices of print speeds and media types, among other choices. Another one of the buttons 30 can be used to reload or advance the print medium through the thermal printer 20. Yet another button 30 can be used to open the thermal printer 20 in order to change the print medium.

The second housing 24 includes a printer module 34 and a motor drive module 36 which are normally latched together. The printer module 34 and the motor drive module 36 are separated by a print medium path 38 along which the print medium passes. By activating another one of the buttons 30, the printer module 34 can be caused to unlatch from the motor drive module 36 so that it can be rotated backwards, in a clockwise direction, to the position seen in FIG. 3. This action opens the print medium path 38 and allows the adjustment and replacement of the print medium which is introduced into the print medium path 38 from a print medium roll 40 (see FIG. 1).

The print medium supplied on the print medium roll 40 is available in a variety of thicknesses, thermal sensitivities, and materials, depending upon the use to be made of the print medium. The print medium supplied from the print medium roll 40 passes through the print medium path 38 and exits through an opening 42 at the front of the second housing 24. If the print medium is a thermal transfer medium, a thermal transfer ribbon is placed in a separate drive mechanism (not shown) contained within the printer module 34. This separate drive mechanism provides supply and take-up rolls for the thermal transfer ribbon. The rolls for the thermal transfer ribbon are controllable independently of the movement of the print medium. This allows saving the ribbon when the print medium contains areas where no printing is required. The motor drive module 36 also contains a cooling fan (not shown) which exhausts air through a side grill 44.

Figure 2:
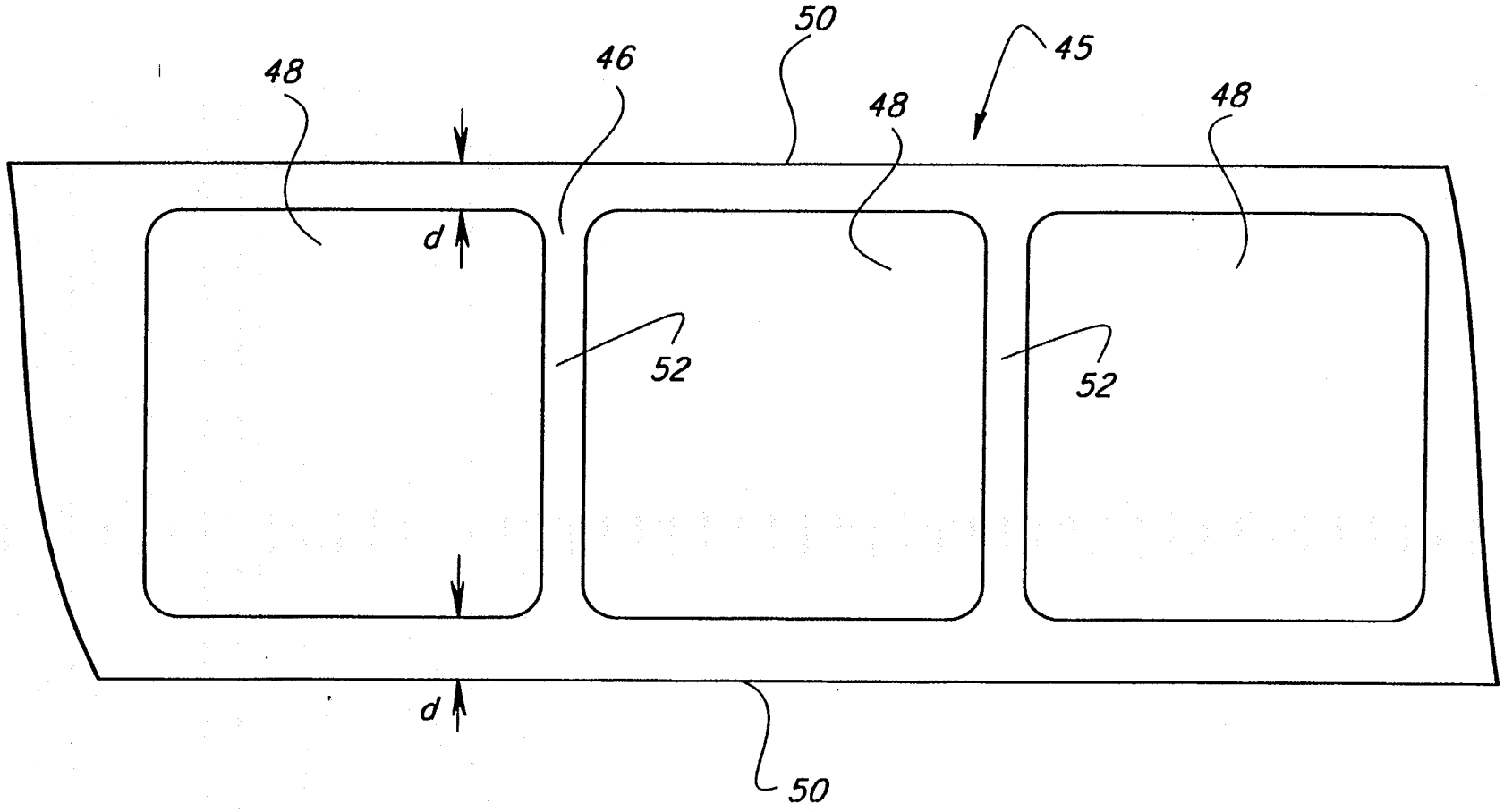
FIG. 2 is a drawing of three labels attached to a backing material used with the thermal printer of FIG. 1.

A conventional print medium 45 shown in FIG. 2 comprises a long strip of backing material 46 with self-adhesive labels 48 adhered at spaced-apart positions along the length of the backing material, and the print medium is rolled to form the print medium roll 40. FIG. 2 shows three labels 48 adhered to a short segment of the backing material 46. The backing material 46 has a pair of parallel straight edges 50 extending in the direction the backing material travels along the print medium path 38. The labels 48 are spaced away from each of the edges 50 by a predetermined distance d. The labels 48 are separated from one another in the direction of travel of the backing material 46 by gaps 52, which extend perpendicularly to the edges 50. The invention is adapted to sense the presence of the gaps 52, or more precisely, the leading edge of a label, by the change in transmissivity of light through the backing material 46 which is caused by the presence or absence of a label 48.

Figure 5:
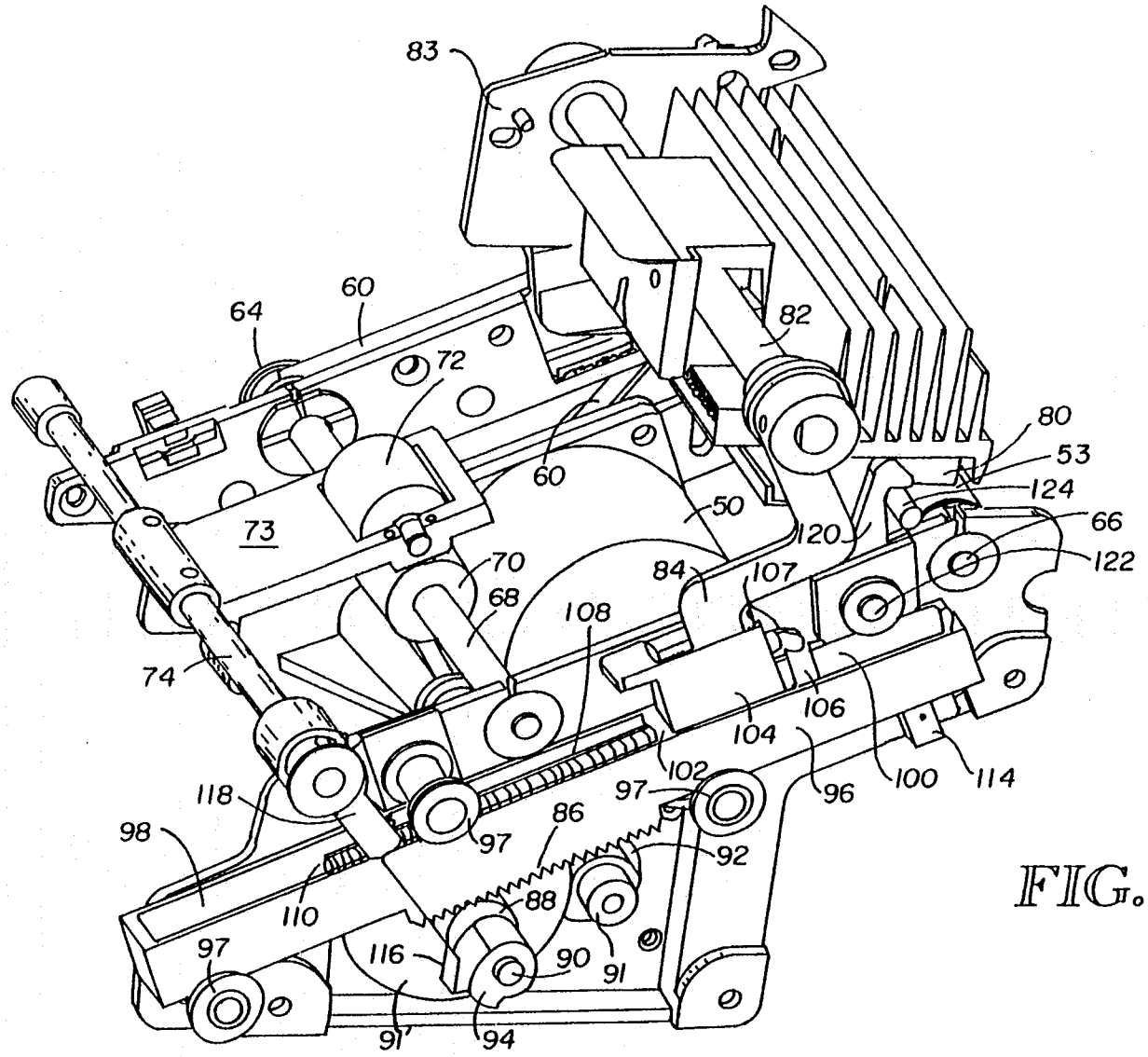
FIG. 5 is a perspective view of a print medium advancement mechanism used with the thermal printer of FIG. 1.

The print medium 45 from the print medium roll 40 passes through the print medium path 38 with the side of the backing material to which the labels 48 of the print medium are attached facing up. As best shown in FIG. 5, the print medium 45 is advanced through the print medium path 38 by an advancement mechanism (to be described subsequently) and forced to pass between a platen roller 53 positioned within the motor drive module 36 at the opening 42 of the print medium path 38 and a thermal printhead 80 (to be described in FIG. 5), which is positioned within the printer module 34. The print medium 45, including the labels 48 which have been printed on, exit through the front opening 42 (see FIG. 1).

When the printer module 34 is latched to the motor drive module 36, the side of the print medium to which the labels 48 are adhered, is forced against the thermal printhead 80 by the platen roller 53. In order to accommodate a wide variety of print media, the pressure between the platen roller 53 and the printhead 80 is variably adjustable.

Figure 3:
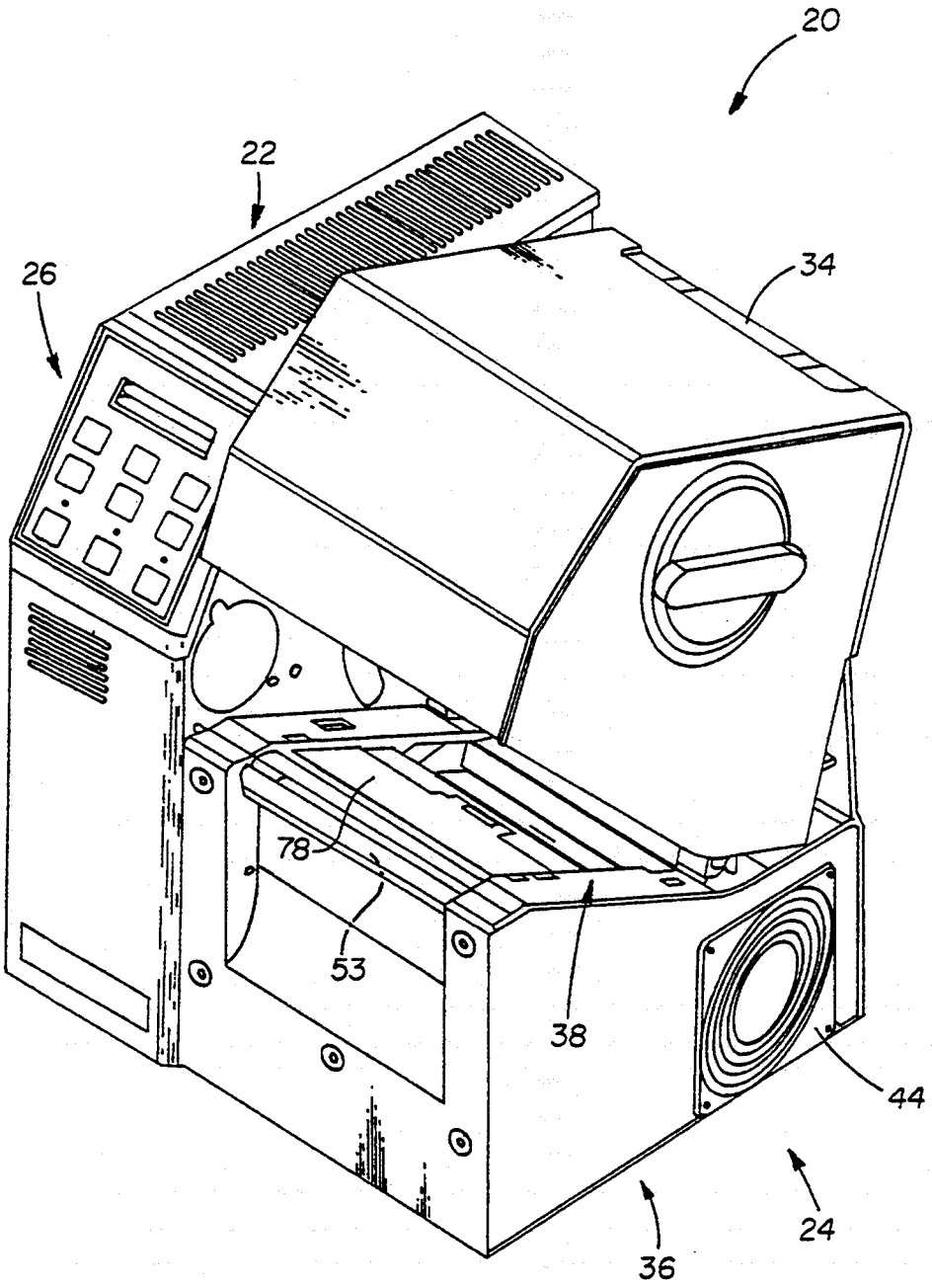
FIG. 3 is a perspective view of the thermal printer of FIG. 1, with the print path being open.
Figure 4:
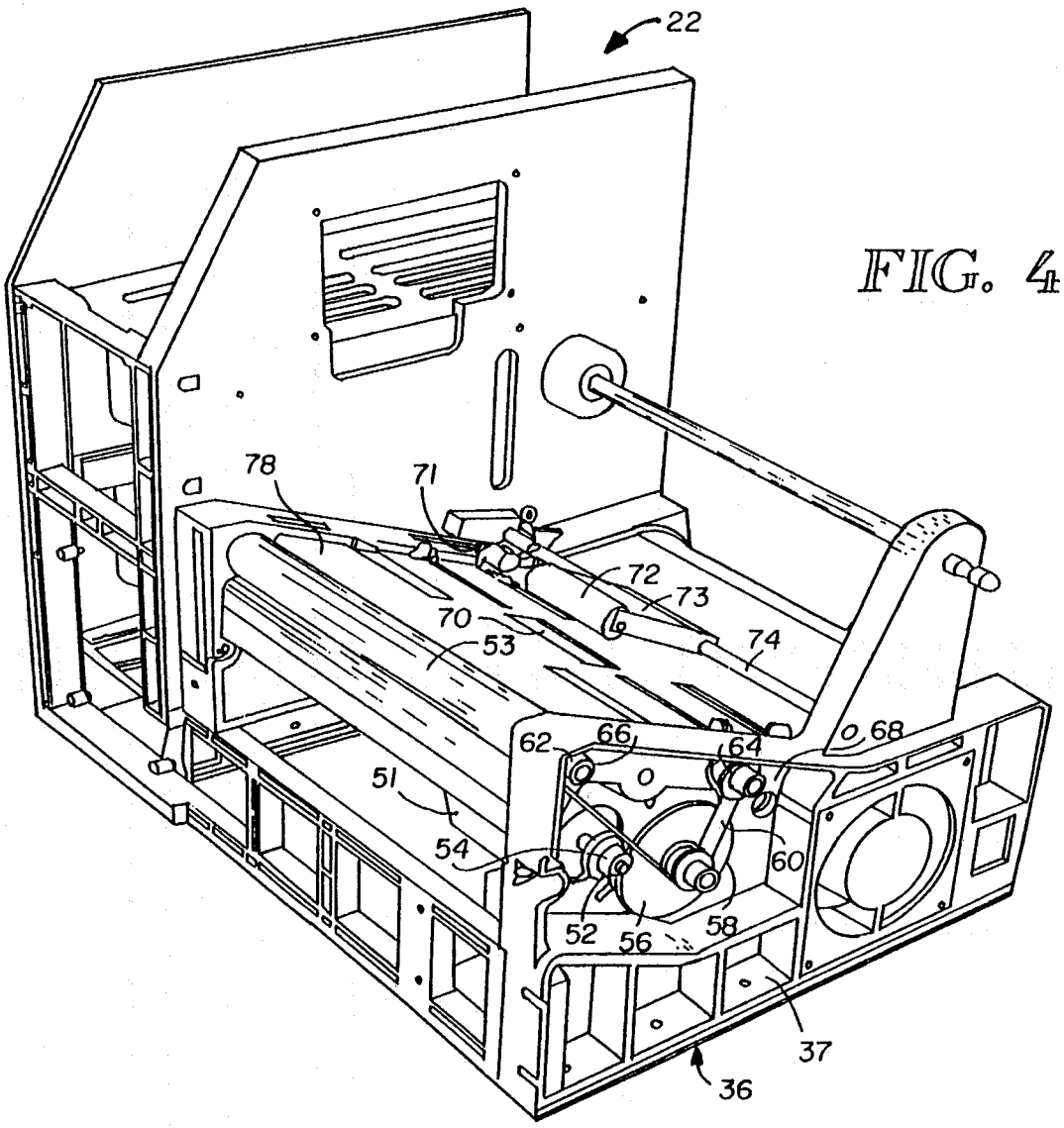
FIG. 4 is a perspective view of a tracking section of the thermal printer of FIG. 1.

FIG. 3 is a perspective view of the thermal printer 20 of FIG. 1, with the print medium path 38 being open. FIG. 4 is a perspective view of the tracking section of the thermal printer 20. The motor drive module 36 includes a stepper motor 51 having a shaft 52 with a drive gear 54 attached near its end. The stepper motor 51 is controlled by electrical circuitry contained in the first housing 22. The electrical circuitry will be described subsequently.

The drive gear 54 engages a large gear 56 which drives a pulley 58. The pulley 58 engages a belt 60 which also passes over two equally-sized pulleys 62 and 64. The pulley 62 is attached to the end of a platen shaft 66 which drives the platen roller 53. The pulley 64 is attached to the end of a slew roller shaft 68 which supports a slew roller 70. A pinch roller 72, which is held by member 73, can be caused to rotate about a pivot shaft 74 toward the slew roller 70 with the print medium therebetween. When this happens, any print medium 45 passing through the print medium path 38 will be driven toward the front opening 42 by the driven slew roller 70. The speed at which the print medium is advanced toward the front opening 42 is governed by the rotational speed of the slew roller shaft 68. The platen shaft 66, which is driven at the same speed as the slew roller shaft 68, causes the print medium to pass between the platen roller 46 and the thermal printhead 80 (shown in FIG. 5) at the same speed.

When the thermal printer 20 is printing, the platen roller 53 moves the print medium 45. Otherwise, as will be seen, the platen roller 53 is not frictionally engaged with the print medium and the slew roller 70 working in conjunction with the pinch roller 72 advance the print medium through the thermal printer 20.

The motor drive module 36 also includes a guide mechanism 78 for guiding the backing material 46 through the print medium path 38. It includes edge guides 79 which guide the edges 50 of the backing material 46.

FIG. 5 is a perspective view of a preferred embodiment of an advancement mechanism 81 used with the thermal printer 20 of FIG. 1. The advancement mechanism 81 is placed below the guide mechanism 78 shown in FIG. 3 and 4. In the advancement mechanism 81 the printhead 80 pivots about a shaft 82 rotatably supported by a frame portion 83 of the printer module 34. The shaft 82 has one end affixed to an arm 84. Accordingly, a clockwise movement of the arm 84 (as viewed in FIG. 5) rotates the shaft 82 clockwise and causes the printhead 80 to move toward the platen roller 53.

The printer module 34 is connected to the motor drive module 36 when the thermal printer 20 is in use by a latch 120 which pivots about a latch shaft 122 that is rotatably supported by a frame portion 37 of the motor drive module 36. The latch 120, which is driven by a mechanism (not shown) in the motor drive module 36, engages a pin 124 which projects from the printer module 34. When latched, the printhead 80 is moved so that it is engaged against the print medium 45 passing between the platen roller 53 and the printhead 80.

Figure 6:
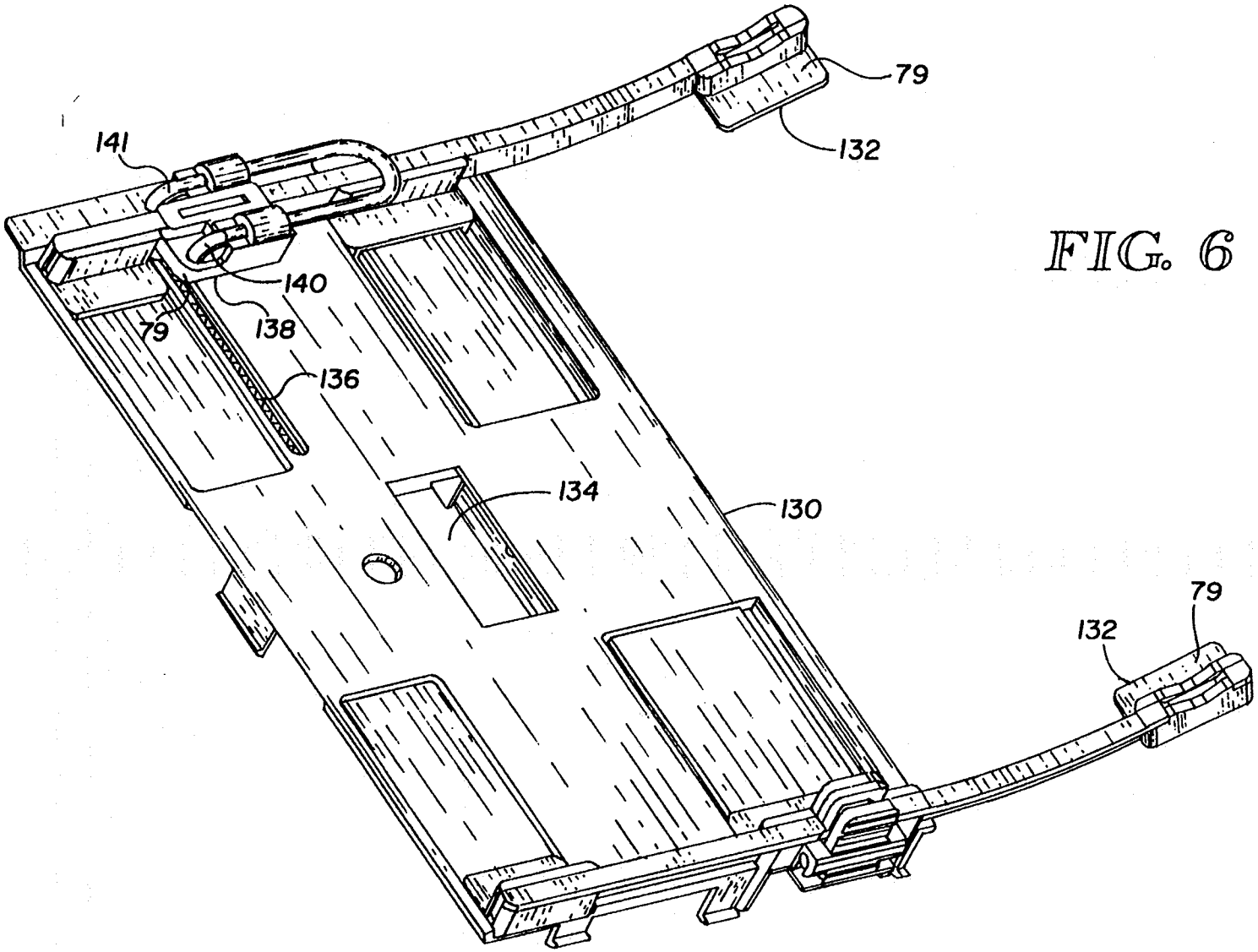
FIG. 6 is a perspective view of a guide mechanism used with the thermal printer of FIG. 1.

FIG. 6 is a perspective view of a preferred embodiment of a guide mechanism for use with the invention. The mechanism includes a frame 130 having two arms 132 which are arranged parallel to one another to guide the backing material 46 received from the roll 40 through the print medium path 38 of the thermal printer 20. A first pair of the edge guides 79 is attached to the frame 130 and a second pair of the edge guides 79 is attached to the ends of the arms 132. The edge guides 79 engage the edges 50 of the 1 backing material 46 and keep the backing material properly located in the print medium path 38.

The thermal printer 20 uses a "center tracking" scheme which keeps the print medium 45 centered in the print medium path 38 regardless of the width of the print medium, which can range between 2.2 and 5.2 inches. The arms 132 are adjusted automatically to fit the width of the backing material 46 specified through the control panel 26 of the thermal printer 20. The frame 130 is located in the motor drive module 36 above. It has an aperture 134 through which the pinch roller 72 can reach the backing material.

An array of light-emitting diodes (LEDs) 136 is attached to one side of the frame 130, and extends perpendicularly to one of the arms 132 to cast a substantially uniform beam of light upward from the frame 130 toward the print medium path 38. Preferably the LEDs 136 emit infrared (IR) light. If the print medium 45 is loaded in the print medium path 38, the light cast by the array of LEDs 136 will strike the downward facing side of the backing material 46.

Opposing the array of LEDs 136 is a fiber optic holder 138, which holds an end portion of a flexible fiber optic 140 oriented perpendicularly to the array of LEDs 136 and a light receiving end of the fiber optic 140 facing toward the array to receive light it generates. The fiber optic holder 138 moves with the arm 132 to which it is attached. As noted above, the arm 132 moves laterally inward and outward to adjust to the width of the backing material 46 being used. The fiber optic 140 is held by the holder 138 so as to always be positioned inward of the adjacent edge 50 of the backing material 46 being guided through the print medium path 38. Therefore, depending upon the width of the backing material 46, the light receiving end of the fiber optic 140 will always be opposite one of the LEDs in the array of LEDs 136 with the backing material 46 therebetween.

Figure 7A:
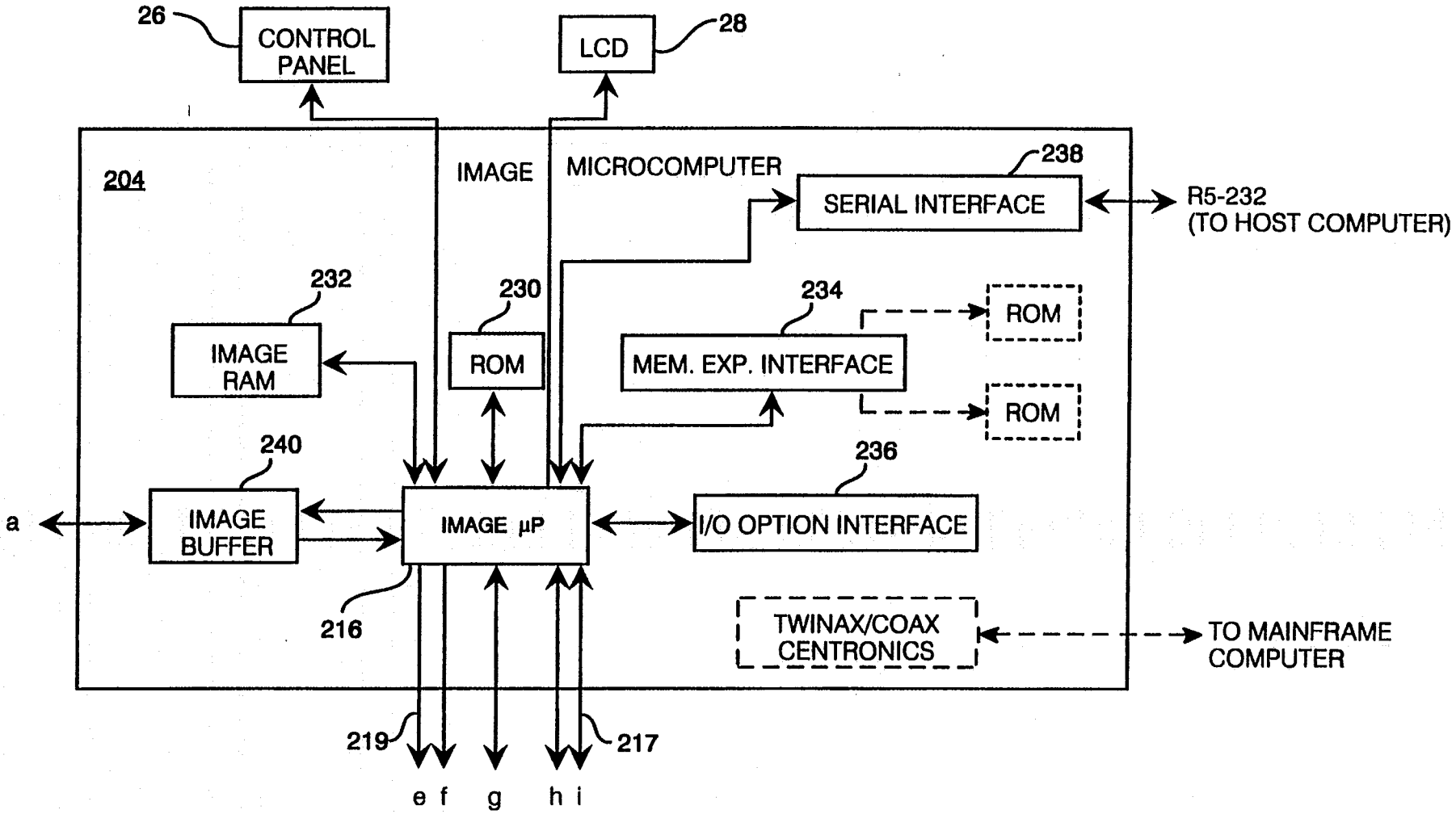
FIGS. 7A–7C comprise a block diagram of the electrical circuitry used with the thermal printer of FIG. 1.
Figure 7B:
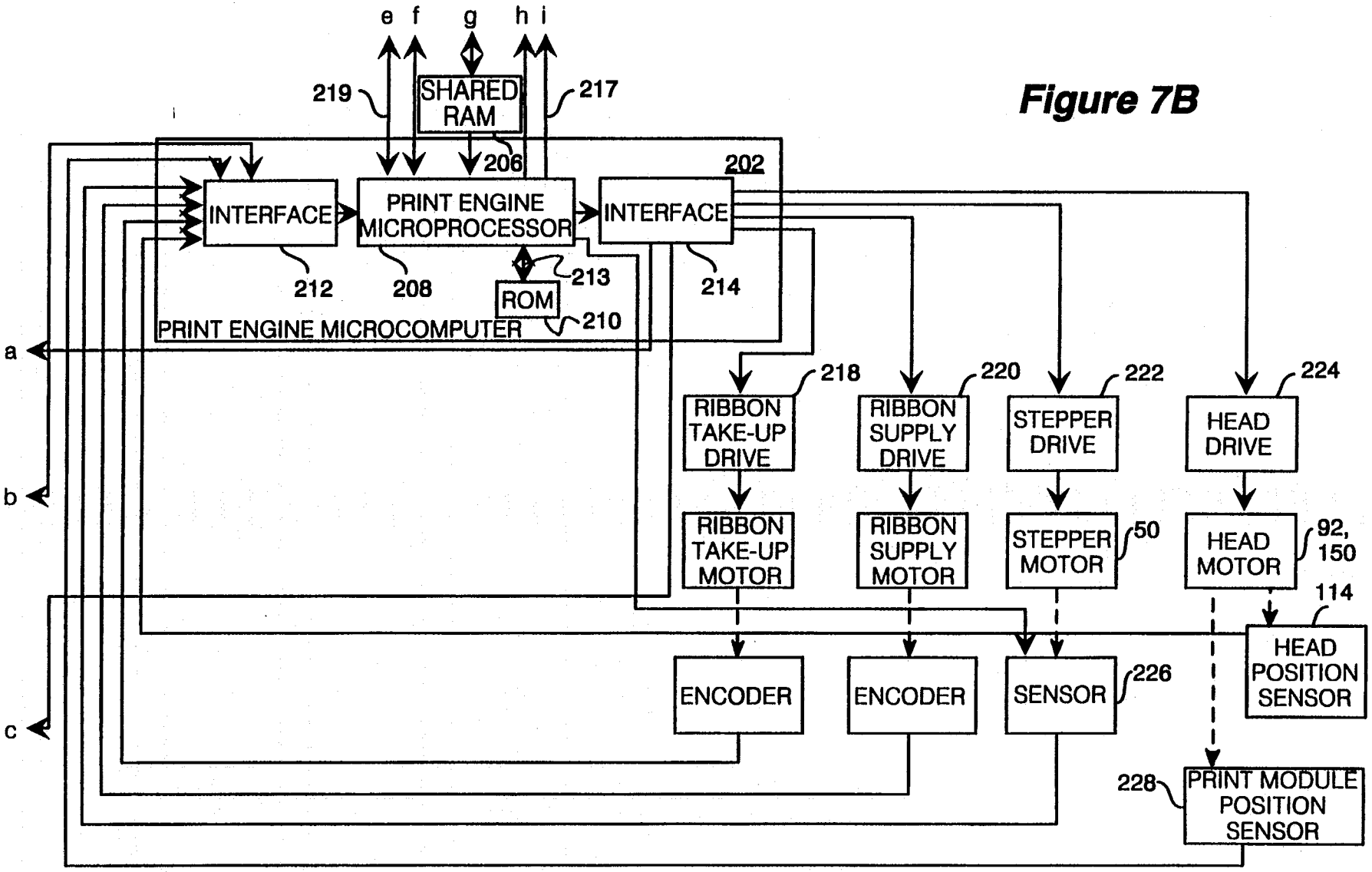
Figure 8:
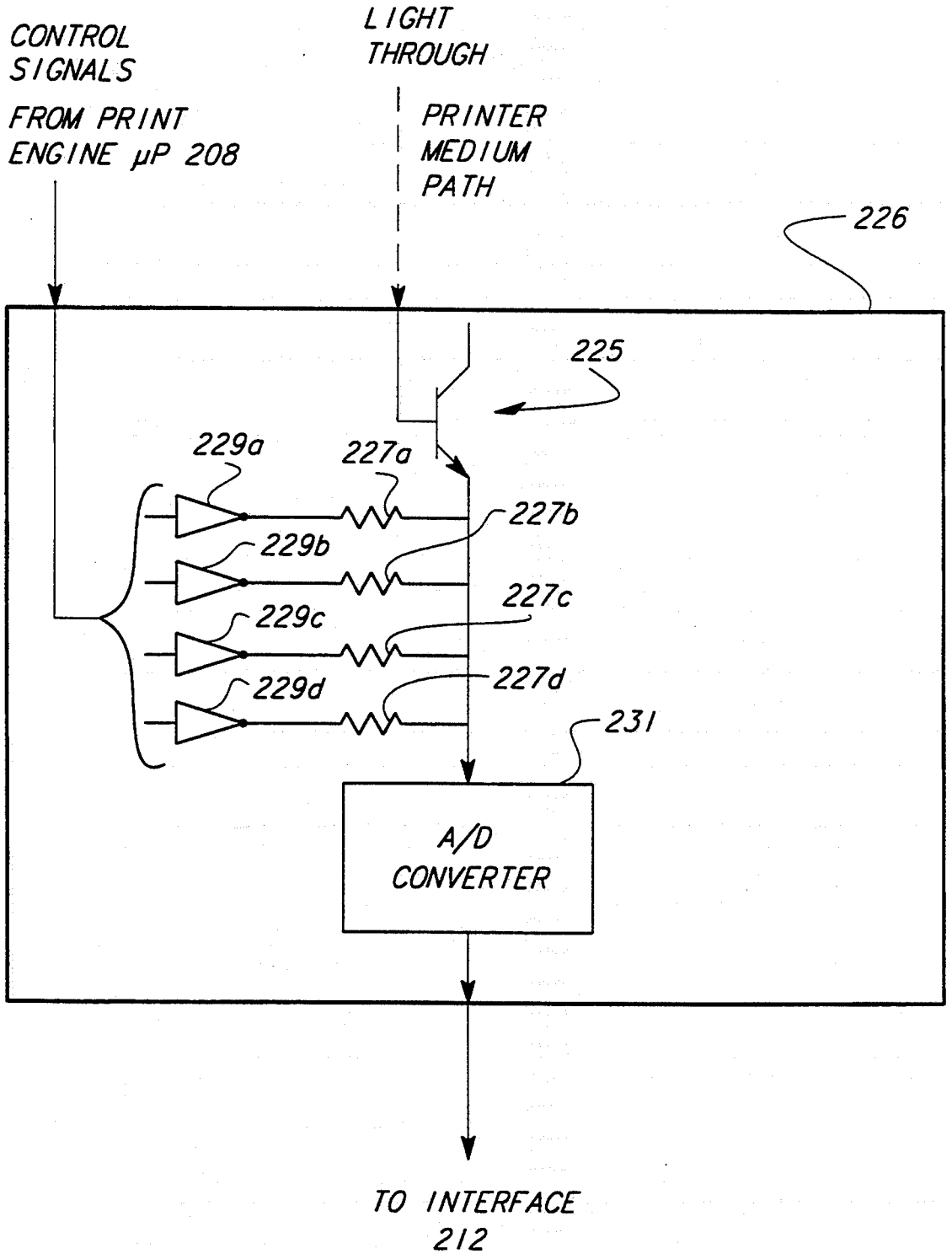
FIG. 8 is a schematic diagram of a portion of a sensor used to control the thermal printer of FIG. 1.

The light collected by the end of the fiber optic 140 is directed to its other end 141 which is located opposite a conventional photodiode 225 which comprises part of a sensor 226, shown in FIGS. 7B and 8. The photodiode is terminated in a selectable load resistance, as will be described subsequently The sensor 226 produces an electrical signal whose level depends upon the amount of light collected by the fiber optic 140. This amount of light depends, in turn, upon whether the backing material 46 passing between the LEDs 136 and the fiber optic 140 has a label 48 attached thereto. This signal is sent to an analog-to-digital converter in the sensor 226. The information in the resulting digital signal is processed by a conventionally programmed print engine microprocessor to measure the actual lengths of the labels 48, the lengths of the gaps between the labels 48, or other features relating to the spacing of the labels 48 along the print medium 45, or even to sense the absence of the print medium 45 in the print medium path 38.

The components described above operate to detect changes in transmissivity between the print medium 45 above (a gap) and the print medium 45 with a label 48 adhered thereto. However, it will be understood by those skilled in the art that, while most labels 48 are somewhat transmissive, some could be opaque. In this case, the above-described components will still serve their functions well. It will also be understood by those skilled in the art that the same operation might be accomplished in some applications by placing the light source and the light detector in the same side of the backing as the print labels and detecting the changes in reflectivity as the labels pass by.

It will also be understood by those skilled in the art that to accommodate for both the variation in the sensitivity of the components chosen to implement the functions of the present invention and the wide range of transmissivity (or opacity) of the print media, the sensor 226 requires a gain setting that can be varied. That is accomplished by choosing an appropriate load resistance for the photodiode 225. As shown in FIG. 8, the load resistance is comprised of the resistors 227A, 227B, 227C, and 227D. These resistors 227 can be grounded through activation of their associated open collector devices 229A, 229B, 229C, and 229D. If the values of resistance of the resistors 227 are chosen correctly, the load resistance that could be applied to the photodiode 225 could have $2^4$ different values. This can be accomplished by causing each of the resistors 227 to have a resistance that differs from the resistance of the others by a factor that is an integral power of two. The open collector devices 229 (which can be field effect transistors, open collector logic gates, etc.) are selectively activated, under software control, by the prior engine microprocessor 208.

With the above-described sensor 226, the thermal printer 20 can be calibrated to account for the variations described above. This is accomplished by passing a particular print medium through the printer 20 in a special calibrate mode that can be chosen by a user. In this calibrate mode, each available gain of the sensor 226 will be tried and one selected. The gain that is selected is the one that results in the largest difference between readings of the A/D converter 231 for the backing only and the backing and label together.

Figure 7C:
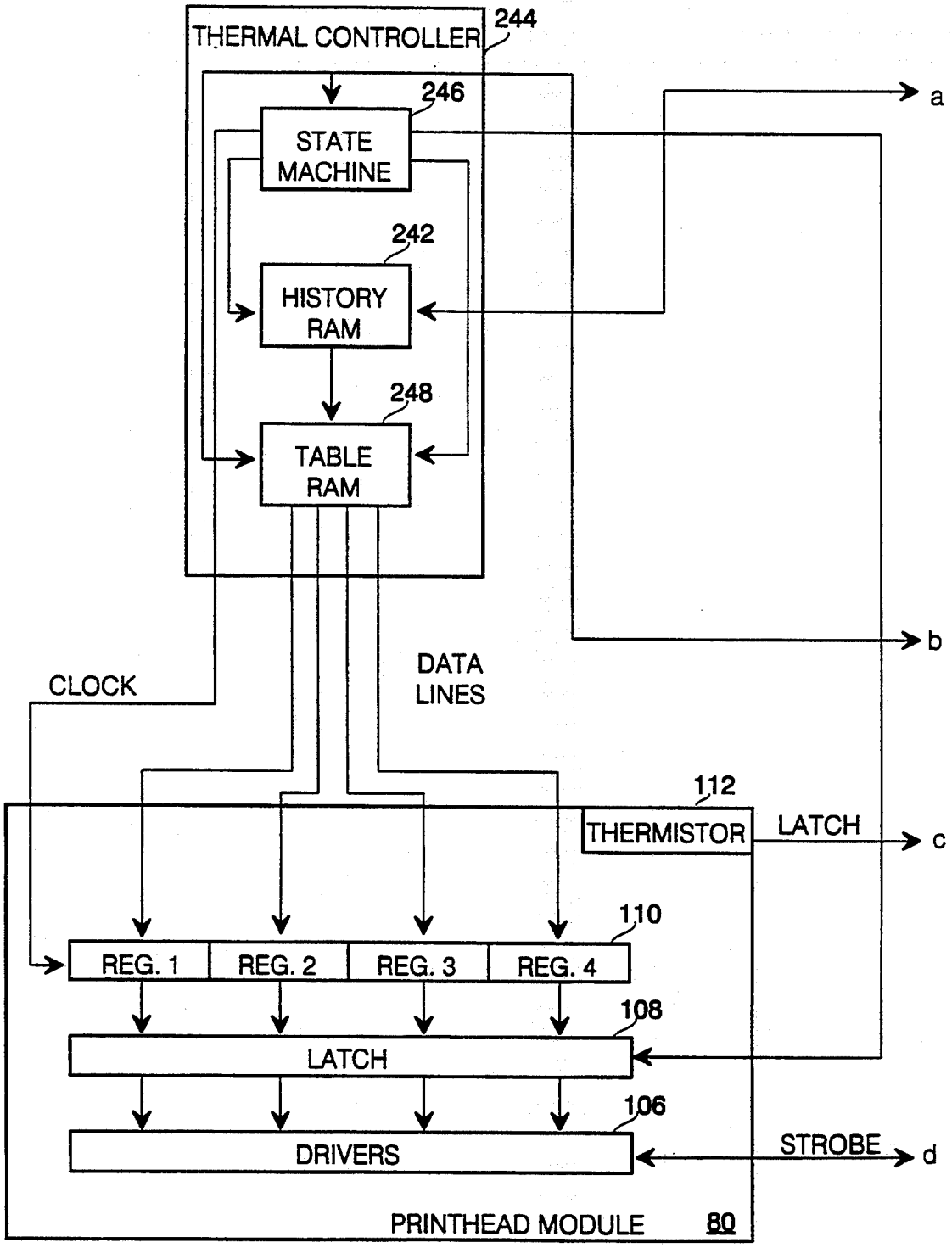

FIGS. 7A–7C comprise a block diagram of the electrical circuitry used with the guide mechanism of FIG. 6. The electrical circuitry includes a print engine microcomputer 202 and an image microcomputer 204. The print engine microcomputer 202 is primarily responsible for controlling the movement of the print medium 45 and the thermal transfer ribbon (if any) through the print medium path 38 and supplying print timing commands to the printhead 80. The image microcomputer 204 produces the images which are to be printed on the print medium. The print engine microcomputer 202 includes a print engine microprocessor 208, a read-only memory (ROM) 210, an input interface 212, and an output interface 214. The ROM 210 communicates with the print engine microprocessor 208 over bidirectional lines. The input interface 212 transmits input signals to the print engine microprocessor 208 and the print engine microprocessor 208 transmits output signals to the output interface 214.

The image microcomputer 204 includes an image microprocessor 216. The print engine microprocessor 208 and the image microprocessor 216 both communicate over bidirectional lines with a shared random access memory (RAM) 206. In addition, the print engine microprocessor 208 communicates interrupt signals to the image microprocessor 216 and the image microprocessor 216 communicates interrupt signals to the print engine microprocessor 208.

Through the output interface 214, the print engine microprocessor 208 sends control signals to a ribbon take-up drive 218, a ribbon supply drive 220, a stepper motor drive 222, and a head motor drive 224. The stepper motor drive 222 produces appropriate drive signals and transmits them to the stepper motor 51. Movements of the print medium 45 caused by the stepper motor 50 are sensed by the sensor 226 which produces signals that are transmitted to the input interface 212. The head motor drive 224 also produces appropriate signals and transmits them to the stepper motors 92, 150. Movements of the printhead 80 caused by the stepper motor 92, 150 are sensed by two sensors, the optical caliper detector 114 and a print module position sensor 228. The optical caliper detector 114 transmits signals to the input interface 212, indicating whether the printhead 80 is in the print mode or the idle mode. The print module position sensor 228 transmits signals to the input interface 212, indicating whether the printer module 34 is disengaged from the motor drive module 36.

As indicated above, detailed illustrative embodiments are disclosed herein. However, other embodiments, which may be detailed rather differently from the disclosed embodiments, are possible. Consequently, the specific structural and functional details disclosed herein are merely representative: yet in that regard, they are deemed to afford the best embodiments for the purposes of disclosure and to provide a basis for the claims herein, which define the scope of the present invention.

We claim:

1. An apparatus for sensing passage of print media carried by a continuous length of light transmissive backing material in longitudinally spaced-apart positions along the continuous length of the backing material as the backing material travels along a print path, the apparatus comprising:

a light source positioned in a fixed location along the print path producing a light on one side of the backing material which illuminates the backing material as it travels by the light source, the light source producing light of sufficient intensity to pass through the backing material; and a light sensor positioned along the print path to a side of the backing material opposite the light source at a position to receive light from the light source passing through the backing material, the light sensor being movable relative to the light source in a direction transverse to the print path, the light sensor detecting transmissivity based on the received light and generating an indicator signal indicative of whether the received light has passed through only the backing material or has passed through both the backing material and the print media carried by the backing material.

2. The apparatus of claim 1 wherein the light source is a linear array of a plurality of individual light sources.

3. The apparatus of claim 2 wherein the linear array of light sources is oriented transverse to the print path.

4. The apparatus of claim 2 wherein the light source comprises a plurality of light-emitting diodes.

5. The apparatus of claim 1 wherein the light sensor detects transmissivity based upon variations in intensity of the received light.

6. The apparatus of claim 1 wherein the light source produces a homogeneous light.

7. An apparatus for sensing passage of print media carried by a continuous length of light transmissive backing material in longitudinally spaced-apart positions along the continuous length of the backing material as the backing material travels along a print path, the backing material having opposite edges, the apparatus comprising;

a light source positioned along the print path producing a light on one side of the backing material which illuminates the backing material as it travels by the light source, the light source producing light of sufficient intensity to pass through the backing material, the light source being a linear array of a plurality of individual light sources, the linear array being oriented transverse to the print path;

a light sensor positioned along the print path to a side of the backing material opposite the light source at a position to receive light from the light source passing through the backing material, the light sensor detecting transmissivity based on the received light and generating an indicator signal indicative of whether the received light has passed through only the backing material or has passed through both the backing material and the print media carried by the backing material; and a pair of guide arms which are laterally movable to engage and guide the opposite edges of the backing material as the backing material travels along a portion of the print path where the light source and light sensor are positioned, the light sensor being attached to one of the guide arms for lateral movement therewith, the linear array of light sources having a length and an orientation such that the light sensor is positioned opposite at least one of the individual light sources as the light sensor is moved laterally with the guide arm to which it is attached.

8. An apparatus for sensing passage of print media carried by a continuous length of light transmissive backing material in longitudinally spaced-apart positions along the continuous length of the backing material as the backing material travels along a print path, the apparatus comprising:

a light source positioned along the print path producing a light on one side of the backing material which illuminates the backing material as it travels by the light source, the light source producing light of sufficient intensity to pass through the backing material; and a light sensor positioned along the print path to a side of the backing material opposite the light source at a position to receive light from the light source passing through the backing material, the light sensor detecting transmissivitv based on the received light and generating an indicator signal indicative of whether the received light has passed through only the backing material or has passed through both the backing material and the print media carried by the backing material, the light sensor comprising a photodetector positioned away from the print path and an optic fiber having two ends, one end being positioned along the print path to a side of the backing material opposite the light source and the other end being positioned adjacent to the photodetector.

9. An apparatus for sensing passage of print media carried by a continuous length of light transmissive backing material in longitudinally spaced-apart positions along the continuous length of the backing material as the backing material travels along a print path, the apparatus comprising:

a light source positioned along the print path producing a light on one side of the backing material which illuminates the backing material as it travels by the light source, the light source producing light of sufficient intensity to pass through the backing material; and a light sensor including a photodetector positioned away from the print path and a light transmitting media having first and second ends, the first end being connected to the photodetector, and the second end being movably positioned along the print path to a side of the backing material opposite the light source at a position to receive light from the light source passing through the backing material, the second end of the light transmissive media being movably relative to the first end and relative to the photodetector, the light sensor detecting variations in the received light and generating an indicator signal indicative of whether the received light has passed through only the backing material or has struck the print media carried by the backing material.

10. The apparatus of claim 9 wherein the light source is a linear array of a plurality of individual light sources.

11. The apparatus of claim 10 wherein the linear array of light sources is oriented transverse to the print path.

12. The apparatus of claim 11, wherein the backing material has opposite edges, the apparatus further including a pair of guide arms which are laterally movable to engage and guide the opposite edges of the backing material as the backing material travels along a portion of the print path where the light source and light sensor are positioned, the light transmitting media being attached to one of the guide arms for lateral movement therewith, the linear array of light sources having a length and an orientation such that the second end of the light transmitting media is positioned opposite at least one of the individual light sources as the light transmitting media is moved laterally with the guide arm to which it is attached.

13. The apparatus of claim 9 wherein the light source comprises a plurality of light-emitting diodes.

14. The apparatus of claim 13 wherein the photodetector comprises a photodiode positioned away from the print path and the light transmitting media is an optic fiber.

15. The apparatus of claim 9 wherein the light sensor detects variations in the intensity of the received light.

16. An apparatus for sensing passage of non-transparent print media carried by a continuous length of light transmissive backing material in longitudinally spaced-apart positions along the continuous length of the backing material as the backing material travels along a print path, the apparatus comprising:

a light source positioned along the print path producing a light on one side of the backing material which illuminates the backing material as it travels by the light source;

a light sensor movably positioned along the print path at a position to receive light produced by the light source after the light has struck at least one of the backing material or the print media, the light sensor being movably adjustable relative to the light source in a direction transverse to the print path, the light sensor detecting variations in the received light and generating an indicator signal indicative of whether or not the received light has struck the print media carried by the backing material; and a monitor receiving the indicator signal from the light sensor and based thereon monitoring passage of the print media along at least a portion of the print path.

17. The apparatus of claim 16 wherein the light source is a linear array of a plurality of individual light sources.

18. The apparatus of claim 17 wherein the linear array of light sources is oriented transverse to the print path.

19. The apparatus of claim 18, wherein the backing material has opposite edges, the apparatus further including a pair of guide arms which are laterally movable to engage and guide the opposite edges of the backing material as the backing material travels along the portion of the print path where the light source and light sensor are positioned, the light sensor being attached to one of the guide arms for lateral movement therewith, the linear array of light sources having a length and an orientation such that the light sensor is positioned to receive light from at least one of the individual light sources as the light sensor is moved laterally with the guide arm to which it is attached.

20. The apparatus of claim 17 wherein the plurality of individual light sources are light-emitting diodes.

21. The apparatus of claim 20 wherein the light sensor comprises a photodetector positioned away from the print path and an optic fiber having two ends, one end being positioned along the print path to receive light from the light source after the light has struck at least one of the backing material or the print media and the other end being positioned adjacent to the photodetector.

22. The apparatus of claim 16 wherein the light sensor detects variations in intensity of the received light.

23. An apparatus for sensing passage of print media carried by a continuous length of light transmissive backing material in longitudinally spaced-apart positions along the continuous length of the backing material as the backing material travels along a print path, the apparatus comprising:

a light source positioned along the print path, said light source including a plurality of lights arranged transverse to the print path, the light source producing a homogeneous light along the plurality of lights on one side of the backing material which illuminates the backing material as it travels by the light source, the light source producing homogeneous light of sufficient intensity to pass through the backing material and the print media carried by the backing material;

a light sensor movable relative to the light source and positioned along the print path to a side of the backing material opposite the light source at a position to receive light from the light source passing through the backing material and any print media carried thereby, the light sensor producing an indicator signal that changes based upon the transmissivity of the backing material and the print media struck by the light to indicate whether the received light has passed through only the backing material or has passed through both the backing material and the print media carried by the backing material; and a monitor receiving the indicator signal from the light sensor and based thereon monitoring the passage of the print media along at least a portion of the print path.

24. An apparatus for sensing passage of print media carried by a continuous length of light transmissive backing material in longitudinally spaced, apart positions along the continuous length of the backing material as the backing material travels along a print path, the apparatus comprising:

a light source positioned along the print path producing a homogenous light on one side of the backing material which illuminates the backing material as it travels by the light source, the light source producing light of sufficient intensity to pass through the backing material and the print media carried by the backing material;

a light sensor positioned along the print path to a side of the backing opposite the light source at a position to receive light from the light source passing through the backing material and any print media carried thereby, the light sensor producing an analog indicator signal that changes based upon the transmissivity of the backing material and the print media struck by the light to indicate whether the received light has passed through only the backing material or has passed through both the backing material and the print media carried by the backing material;

a monitor receiving the indicator signal from the light sensor and based thereon monitoring the passage of the print media along at least a portion of the print path; and converter with a controllable gain, the converter converting the analog indicator signal to a digital signal.

25. The apparatus of claim 24, further including electronic circuitry automatically controlling the gain of the converter to generate a preselected differential between the digital signal generated when the received light passes through only the backing material and the digital signal generated when the received light is received toward both the backing material and the print media carried by the backing material.

26. A thermal printer which detects an edge of a print media carried by a continuous length of light transmissive backing material in longitudinally spaced-apart positions along the continuous length of the backing material as the backing material travels along a print path, the edge extending generally transverse to the print path, the apparatus comprising:

a printer housing having a print head and the print path therein;

a light source positioned along the prim path producing a light on one side of the backing material which illuminates the backing material as it travels by the light source, the light source producing light of sufficient intensity to pass through the backing material and the print media carried by the backing material;

a light sensor positioned along the print path to a side of the backing material opposite the light source at a position to receive light from the light source passing through the backing material, the light sensor detecting variations in the received light as the backing material carries the print media along the print path and the edge of the print media past the light sensor, based upon whether the received light has passed through only the backing material or has passed through both the backing material and the print media carried by the backing material, the light sensor generating an analog indicator signal indicating passage of the edge by the light sensor; and a converter with a controllable gain, the converter converting the analog indicator signal to a digital signal.

27. The thermal printer of claim 26 wherein the light source is a linear array of a plurality of individual light sources.

28. The thermal printer of claim 27 wherein the linear array of light sources is oriented transverse to the print path.

29. The thermal printer of claim 28, wherein the backing material has opposite edges, the apparatus further including a pair of guide arms which are laterally movable to engage and guide the opposite edges of the backing material as the backing material travels along a portion of the print path where the light source and light sensor are positioned, the light sensor being attached to one of the guide arms for lateral movement therewith, the linear array of light sources having a length and an orientation such that the light sensor is positioned generally opposite at least one of the individual light sources as the light sensor is moved laterally with the guide arm to which it is attached.

30. The thermal printer of claim 27 wherein the light source comprises a plurality of light-emitting diodes.

31. The thermal printer of claim 30 wherein the light sensor comprises a photodetector positioned away from the print path and an optic fiber having two ends, one end being positioned along the print path to a side of the backing material opposite the light source and the other end being positioned adjacent to the photodetector.

32. The thermal printer of claim 26 wherein the light sensor detects variations in intensity of the received light.

33. The thermal printer of claim 26 wherein the light source produces a homogeneous light.

34. (Three Times Amended) A method for sensing passage of print media carried by a continuous length of light transmissive backing material in longitudinally spaced-apart positions along the continuous length of the backing material as the backing material travels along a print path, comprising the steps of:

(a) producing a light on one side of the backing material which illuminates the backing material as it travels along the print path, the light being produced by a light source and the light having a sufficient intensity to pass through the backing material;

(b) movably adjusting a light sensor relative to the light source in a direction transverse to the print path to a selected position;

(c) receiving with the light sensor the light from the light source at an opposite side of the backing material after it has passed through the backing material and any print media carried thereby;

(d) detecting variations in the received light; and (e) generating an indicator signal based on detected variations in the received light indicative of whether the received light has passed through only the backing material or has passed through both the backing material and the print media carried by the backing material.

35. The method of claim 34 wherein the light is produced using a linear array of individual light sources.

36. The method of claim 35 wherein the linear array of light sources is oriented transverse to the print path.

37. The method of claim 34 wherein the light produced is substantially homogeneous light.

38. The method of claim 34, further including the steps of positioning a photodetector away from the print path, positioning one end of an optic fiber opposite the light source, and positioning the other end of the optic fiber adjacent to the photodetector.

39. The method of claim 34 wherein the step of detecting variations in the received light detects variations in the intensity of the received light.

40. The method of claim 34 wherein the step of detecting variations in the received light detects transmissivity of the backing material with and without the print media thereon.

41. A method for sensing passage of print media carried by a continuous length of light transmissive backing material in longitudinally spaced-apart positions along the continuous length of the backing material as the backing material travels along a print path, the backing material having opposite edges, comprising the steps of:

(a) producing a light using a linear array of individual light sources, the linear array being oriented transverse to the print path, on one side of the backing material which illuminates the backing material as it travels along the print path, the light having a sufficient intensity to pass through the backing material;

(b) receiving light from the light source at an opposite side of the backing material after it has passed through the backing material and any print media carried thereby;

(c) detecting variations in the received light;

(d) generating an indicator signal based on detected variations in the received light indicative of whether the received light has passed through only the backing material or has passed through both the backing material and the print media carried by the backing material;

(e) laterally guiding the opposite edges of the backing material as the backing material travels along a portion of the print path where the light is produced using a pair of laterally movable guide arms selectively moved to accommodate a known width of the backing material;

(f) attaching to one of the guide arms for movement therewith a light sensor to receive light from the linear array of light sources; and (g) providing the linear array of light sources with a length and an orientation such that the light sensor is positioned opposite at least one of the individual light sources as the light sensor is moved laterally with the guide arm to which it is attached.

42. The apparatus of claim 16 wherein the continuous length of backing material has an edge extending parallel to the print path, and the light sensor is movably adjustable relative to the edge of the backing material in the direction transverse to the print path.

43. The apparatus of claim 25 wherein the converter is adapted to select a gain that corresponds to a largest differential between the digital signal generated when the received light passes through only the backing material and the digital signal generated when the received light passes through both the backing material and the print media carried by the backing material.

44. The thermal printer of claim 26, further including electronic circuitry automatically controlling the gain of the converter to generate a preselected differential between the digital signal generated when the received light passes through only the backing material and the digital signal generated when the received light passes through both the backing material and the print media carried by the backing material.

45. The method of claim 34 wherein the backing material has an edge parallel to the print path and the step of movably adjusting a light sensor includes adjusting the position of the light sensor to a selected distance away from the edge of the backing material in a direction transverse to the edge.

46. The method of claim 36 wherein the step of producing a light includes producing homogeneous light along the linear array of light sources.

* * * * *

UNITED STATES PATENT AND TRADEMARK OFFICE

CERTIFICATE OF CORRECTION

PATENT NO. : 5,438,349
DATED : August 1, 1995
INVENTOR(S) : Duane M. Fox and Joel A. Schoen It is certified that error appears in the above-indentified patent and that said Letters Patent is hereby corrected as shown below:

In column 8, claim 8, line 45, please delete "transmissivitv" and substitute therefore --transmissivity--.

In column 9, claim 15, line 44, after "variations in", please delete "the".

In column 10, claim 19, line 11, after "travels along", please delete "the" and substitute therefore --a--.

In column 10, claim 24, line 67, please delete "spaced, apart" and substitute therefore --spaced-apart--.

In column 11, claim 24, line 11, after "backing", please insert --material--.

In column 11, claim 26, line 48, please delete "prim" and substitute therefore --print--.

In column 12, claim 29, line 20, please delete "generally".

In column 12, claim 34, line 37, please delete "(Three Times Amended)".

Signed and Sealed this

Second Day of January, 1996

*Attest:*

Bruce Lehman

BRUCE LEHMAN

*Attesting Officer*

*Commissioner of Patents and Trademarks*